United States Patent [19]

Hellman et al.

[11] 4,006,329

[45] Feb. 1, 1977

[54] SWITCH FOR SENSING A SELECTED RATIO BETWEEN TWO DIFFERENT PRESSURES

[75] Inventors: Robert R. Hellman, Bridgeport; Marion T. Mikita, Milford, both of Conn.

[73] Assignee: Westport Development & Mfg. Co. Inc., Milford, Conn.

[22] Filed: May 14, 1975

[21] Appl. No.: 577,537

[52] U.S. Cl. ..... 200/83 D; 73/407 PR; 92/43

[51] Int. Cl.[2] ..... H01H 35/32

[58] Field of Search ..... 200/83 S, 83 D, 83 W, 200/83 Y, 83 C; 92/35, 37, 39, 43; 73/407 PR, 410

[56] References Cited

UNITED STATES PATENTS

| | | | |
|---|---|---|---|
| 2,471,838 | 5/1949 | Ross | 200/83 C |
| 2,477,233 | 7/1949 | Bristol | 73/410 |
| 2,697,764 | 12/1954 | Burlingham | 200/83 C |
| 2,850,871 | 9/1958 | Drake | 73/407 PR |
| 3,046,369 | 7/1962 | Hicks | 200/83 C |
| 3,742,165 | 6/1973 | Hellman | 200/83 W |

*Primary Examiner*—Gerald P. Tolin
*Attorney, Agent, or Firm*—Ernest M. Junkins

[57] ABSTRACT

A device for providing a measurement of the value of the ratio of two pressures by sensing the position of a member that is urged in one direction by one pressure and oppositely by the other pressure with the element further having both pressures set against the same movable support of the element. A third pressure of essentially a high vacuum acts on the remainder of the element not acted on by the other pressures and minimizes the effects of temperature while enabling the device to be precise over a wide range of pressures.

2 Claims, 1 Drawing Figure

SWITCH FOR SENSING A SELECTED RATIO BETWEEN TWO DIFFERENT PRESSURES

Differential pressure ratio devices to which the present invention relates are responsive to the ratio of the numerical values of two pressures and not to just the values themselves. If it is desired to provide an indication of the occurrence of the ratio of, for example, 5.5 to 1, values of pressures of 55 and 10, 247.5 and 45 or 137.5 and 25 will each produce the same indication.

It is generally desired to have such a device provide the indication of the existence of the ratio quite precisely within ±0.05% of the ratio. Further, the preciseness is desired to be maintained even when the device is subjected to the pressures occuring over a wide range and when the device is used in an environment which has changing ambient conditions of, for example, temperature. In an attempt to satisfy at least some of these requirements, heretofore suggested devices have generally been quite complex in construction which not only rendered them expensive, but also tended to make them susceptible to malfunctioning. Attempts to minimize such complexity has generally reduced their preciseness of operation and range which in many instances rendered such heretofore known devices unacceptable for failure to meet the above-noted requirements.

It is accordingly an object of the present invention to provide a differential pressure ratio switch which is capable of quite precisely measuring a desired ratio even over a wide range of operating and environmental conditions.

Another object of the present invention is to achieve the above object with a device that is extremely simple in construction, composed of few parts and relatively economical to manufacture.

A further object of the present invention is to provide a differential pressure ratio device that has a minimum tendency to malfunction, is durable and reliable in use, is quite resistant to deformation by abnormal conditions and is quite easily adjusted to precisely the desired ratio.

In carrying out the present invention the differential pressure ratio device includes a first bellows which has one end secured to a fixed base and its other end secured to a movable header so as to form a closed chamber. Positioned within this chamber is a second tubular bellows of smaller diameter and it also has one end secured to the fixed base and its other end secured to the same movable header. The construction provides a closed annular chamber existing between the two tubular bellows. A sealed container including the fixed base forms a closed chamber in which the two bellows are disposed.

The higher of the two pressures whose ratio is to be sensed is introduced into the interior of the second bellows while the pressure having the lower value is introduced into the container. Also the annular chamber is essentially evacuated to an absolute zero pressure. The lower pressure thus acts on the outside of the first bellows and movable header to urge the header towards its base while the higher pressure acts on the inside of the first bellows and urges the header oppositely, away from the base. As both pressures thus act against the same elements, the spring or mechanical effect of the first bellows upon the movement of the header becomes balanced while by evacuating the annular chamber effects of environmental changes are essentially eliminated.

The movement of the header is sensed precisely by a snap action electrical switch that produces an indication of the precise position that the header assumes when the two pressures have the selected ratio.

Other features and advantages will hereinafter appear.

Figure 1:
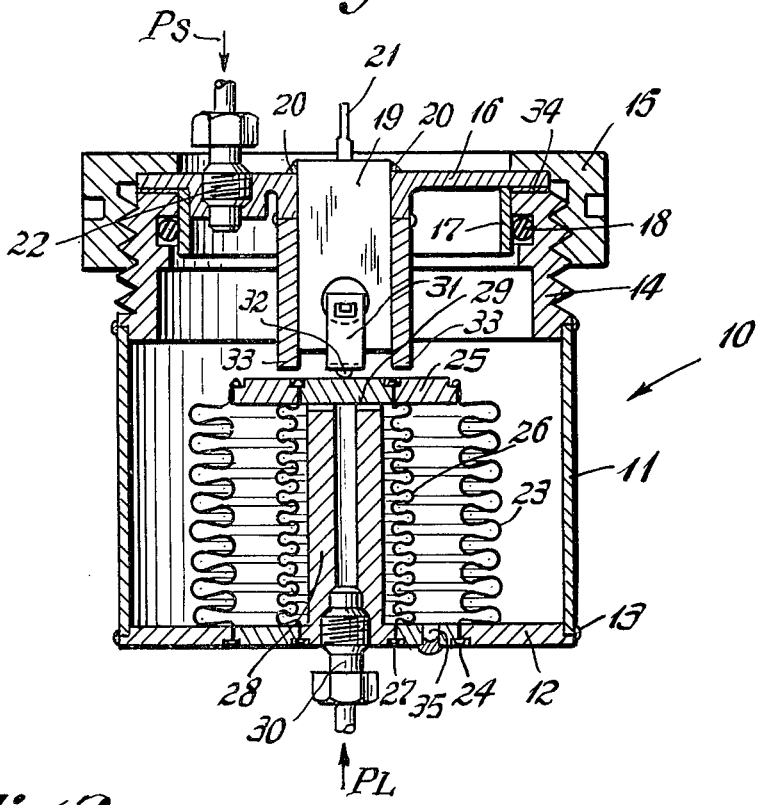
FIG. 1 is an axial section of the differential pressure ratio switch of the present invention, essentially full size.
Figure 2:
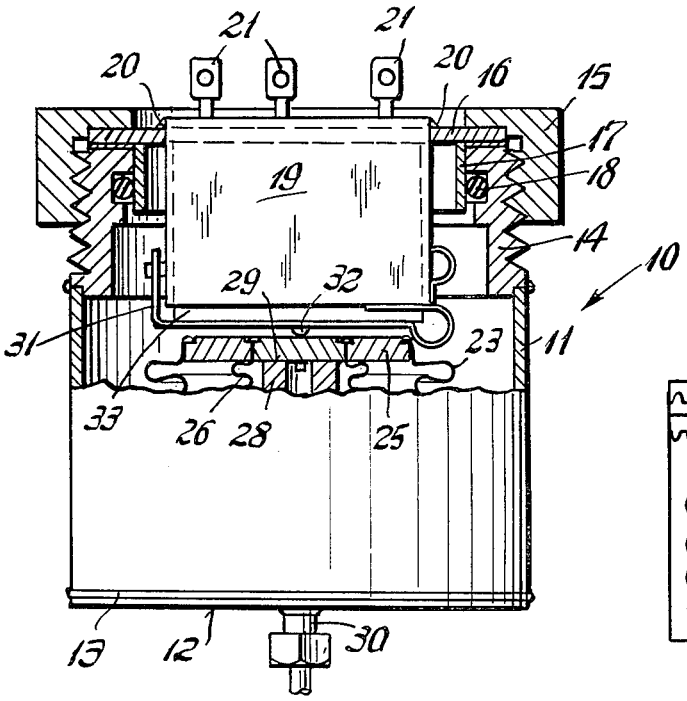
FIG. 2 is an elevation thereof partly in section.
Figure 3:
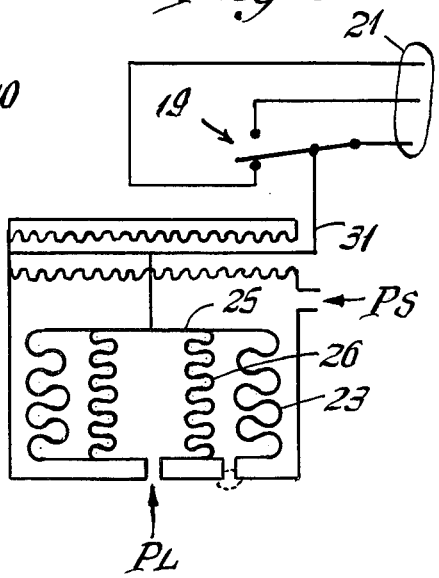
FIG. 3 is a diagrammatic representation of the device.

Referring to the drawing, the differential pressure ratio switch of the present invention is generally indicated by the reference numeral 10 and includes a tubular housing member 11 secured to a circular base 12 as by peripheral welding 13. A threaded annular ring 14 having the shape shown is also peripherally welded to the housing 11 at its upper end. A threaded cap 15 threads onto the exterior of the ring 14.

A cover 16 has its peripheral edges clamped between the ring 14 and the cap 15 and includes an annular flange 17 which sealingly engages an O-ring 18 positioned in a circular notch formed on the interior of the ring 14. The cover has a central rectilinear opening therein with an electrical switch 19 of the hermetically sealed type, such as disclosed in my U.S. Pat. No. 3,609,269, assigned to the assignee of the present invention, being located therein and secured as by a welding 20 to the cover. The cover 16 together with the annular flange 17, O-ring 18, cap 15, ring 14, tubular member 11 and base 12 form a sealed enclosure. Terminals 21 of the switch 19, however, extend outwardly therefrom for enabling electrical connection to the switch.

In accordance with the present invention wherein it is desired to measure the ratio between the values of a smaller pressure, PS, and a larger pressure, PL, the cover 16 is formed with a threaded opening for receiving a conduit 22 which is in communication with the lower pressure PS so that the interior of the container is subjected to this lower pressure.

Prior to the assembly of the container, an outer tubular bellows member 23 has its lower end secured to the base 12, as by welding 24, and its upper end secured to the periphery of a disk-shaped movable header 25. An inner tubular bellows member 26 also has its lower end secured as at 27 to the base while its upper end is secured concentrically with the bellows 23 to the header 25. The joints with the bellow member's ends are fluid tight which may be facilitated by forming the base 12 and header 25 from joined together mating pieces.

A rigid pipe 28 is also secured to the base and extends concentrically within the inner bellows with the grooved end 29 thereof constituting a stop for limiting the downward movement of the header 25. A conduit 30 is threadingly connected to the interior of the pipe 28 and is in communication with the larger pressure, namely, PL.

With the above construction it will be understood that the pressure PS introduced through the conduit 22 into the interior of the device 10 acts on the outer (or upper as shown) surface of the header 25 and increasing values thereof provide a force that urges the header 25 towards the base 12. The larger pressure PL fills the chamber formed by the inner member 26 and acts against the lower surface of the header 25 to urge the header 25 upwardly away from the base.

The force which the pressure PS exerts is dependent on its value and the effective area of the upper surface of the header and bellows against which it acts. Similarly, the force which the pressure PL exerts is dependent on its value and the effective area of the lower surface of the header and bellows within the tubular member 26. The relative area against which the two pressures act are made to be inverse to the ratio which is desired to be sensed and hence the lower pressure PS acts against an effective area which is, if a ratio of 5.5 to 1 is desired to be sensed, 5.5 times the area which the pressure PL acts against. Thus, it requires 5.5 units of pressure change in the value of the large pressure to effect the same force on the header 25 in one direction as one unit of pressure change in the value of the smaller pressure PS.

The header assumes a position within its path of movement when the two pressures have the desired ratio. This activates the switch 19 through an arm 31 and a projection 32 to produce a signal on its output terminals 21 providing an indication of the occurrence of the desired pressure ratio. The switch 19 is quite sensitive and capable of providing an indication within less than one thousandth of an inch when the header moves upwardly to the actuating position.

A pair of stops 33 are secured to the cover 16 to extend along each side thereof and serve to limit upward movement of the header 25. The stops 33 and the end 29 of the pipe 28 limit the extent of the header's movement to that which will not cause deformation or distortion of the bellow members 23 and 26 or switch 19.

The positioning of the switch 19 for actuation at precisely the position where the header is located for the desired pressure ratio is easily achieved by forming the length of the ring 14 so that an annular metal washer 34 may be positioned between the lower end of the cover 16 and the adjacent end of the ring 14. The thickness of the washer 34 may be easily changed to that necessary for locating the switch. Thus, by altering the thickness of the washer, variations produced in manufacturing may be readily accommodated.

It will be understood that the pressure PS in attempting to move the header 25 downwardly acts against the spring rates of the bellows 23 and 26 while the pressure PL, acts in the opposite direction also against the spring rates of the bellows 23 and 26. The spring rates are made to be essentially linear in the range of movement of the header and thus as both pressures act thereagainst, the possibility of error being introduced by the bellows 23 is thus effectively eliminated. Further, the interior of the bellows 23 and the exterior of the bellows 26 form a sealed annular chamber which includes a portion of the header 25. In accordance with the present invention, this chamber is evacuated by way of an opening 35 in the base 12 to an essentially zero absolute pressure and then sealed. With essentially no fluid or gas within the annular chamber, temperature and pressure changes have no fluid to act upon and hence such changes will accordingly have essentially no effect on the operation of the device.

If, of course, it is desired to have the switch operate at various different ratios depending on the ambient temperature, then the chamber may be filled with a fluid having a selected pressure with the changes in temperature changing the pressure which such a fluid would exert on the header 25 and accordingly the ratio at which the switch would operate. Such a construction would vary the selected ratio in accordance with known gas laws.

If desired to continuously monitor the actual ratio, other than sense the occurrence of one selected ratio, a linear movement sensing transducer may be used in place of the switch 19.

The device may be mounted in any convenient manner and may be, if desired, a shock resistant mounting. It is not essential that the device be always mounted vertically as disclosed in the drawing.

It will accordingly be understood that there has been disclosed a differential pressure ratio device which provides an indication that at a selected ratio two different pressures have occurred. The occurrence is sensed quite accurately, for example, within $\pm 0.05$ of a ratio of 5.5 to 1 and further the switch will repeat being actuated at such a position within a range of repeatability of $\pm 0.013$ which is equivalent to a pressure range of $\pm 0.2$ psi of the larger pressure PL. Moreover, by the present construction, the range of the values of the larger pressure PL may extend from 13 to 250 psia with corresponding limits of 10 psia to 50 psia for the smaller pressure. Over this range, the switch is operable within the above-noted tolerances.

The device is rendered extremely precise but yet economically constructed by having the lower pressure act on a large surface of a movable element supported by a bellows member while the higher pressure works on a smaller surface of the movable element with the urgings by each pressure being opposite. By having the remainder of the surface of the element essentially free from any gas pressure and by supporting the element by the same member which has a linear spring rate, the preciseness and accuracy for the range of operation is obtained and the device is rendered relatively immune from the effects of environmental conditions.

Variations and modifications may be made within the scope of the claims and portions of the improvements may be used without others.

We claim:

1. A differential pressure ratio device for providing an indication of the existence of at least one selected value of the ratio between the values of a small pressure and a large pressure comprising a closed housing having a base, a header having one surface and an opposite surface located within the housing, a first tubular bellows having one end completely secured to the base and its other end completely secured to the one surface of the header, a second bellows having one end completely secured to the base and its other end completely secured to the one surface of the header, said second bellows being smaller than said first bellows whereby they form a closed annular chamber with the base and the one surface of the header, means causing a set low absolute pressure to exist in the annular chamber, means adapted to introduce a large pressure into the interior of the second bellows to act on the one surface of the header enclosed by the second bellows, means adapted to introduce a small pressure into the closed housing to subject the opposite surface of the header thereto, means for providing an indication of at least one position of the header, the effective area of the opposite surface subjected to the small pressure being essentially equal to the selected value of the pressure ratio times the effective area of the one surface subjected to the large pressure within the second bellows, said means for providing an indication including an electrical switch having an actuator portion adapted to engage the opposite surface and terminals extending through the closed housing with the switch being located to be actuated at the position which the opposite surface of the header assumes at the selected value of the ratio and in which there are alterable means for adjusting the location of the switch with respect to the header, said alterable means including means forming the housing in two separable parts, one of said parts having the base to which the bellows carrying the header are secured, the other part having means for supporting the electrical switch and joining means for connecting the two parts to enable relative movement of the switch with respect to the header to enable adjustment of the location of the switch.

2. The invention as defined in claim 1 in which there are rigid means for setting the limits of the movement of the header in both directions with said means including a rigid element carried by the one part and engageable with the one surface of the header and a rigid element carried by the other part and engageable with the opposite surface of the header.

* * * * *